US005910053A

United States Patent [19]

Scalise

[11] Patent Number: 5,910,053

[45] Date of Patent: Jun. 8, 1999

[54] GOLF-SWING PRACTICE DEVICE

[75] Inventor: Patrick A. Scalise, West Hollywood, Calif.

[73] Assignee: AWL Golf, Culver City, Calif.

[21] Appl. No.: 09/093,048

[22] Filed: Jun. 8, 1998

[51] Int. Cl.[6] ..... A63B 69/36

[52] U.S. Cl. ..... 473/257; 473/270; 473/278

[58] Field of Search ..... 473/257, 266, 473/268, 218, 270, 278, 279

[56] References Cited

U.S. PATENT DOCUMENTS

| | | | |
|---|---|---|---|
| 1,596,110 | 8/1926 | Lynch . | |
| 1,790,762 | 2/1931 | Page . | |
| 3,311,377 | 3/1967 | Holbus . | |
| 3,542,369 | 11/1970 | Anderson . | |
| 3,899,179 | 8/1975 | Vlach . | |
| 4,181,311 | 1/1980 | Lawlor | 473/257 |
| 5,139,263 | 8/1992 | Feo | 473/257 X |
| 5,398,937 | 3/1995 | Regan | 473/257 |
| 5,630,719 | 5/1997 | Franklin . | |

FOREIGN PATENT DOCUMENTS

| | | |
|---|---|---|
| 0250643 | 7/1988 | European Pat. Off. . |
| WO90/06158 | 6/1990 | WIPO . |

*Primary Examiner*—George J. Marlo
*Attorney, Agent, or Firm*—A. M. Fernandez

[57] ABSTRACT

A golf-swing practice device is disclosed as a vinyl plastic sheet imprinted with guide marks, namely a plan view of a golf-swing practice device in accordance with the present invention with four marks, namely an arrow to be aligned with a target, a bar perpendicular to the arrow and behind an aperture for a ball tee, and two lines crossing on the arrow in front of the aperture and equally spaced from the center of the aperture.

8 Claims, 1 Drawing Sheet

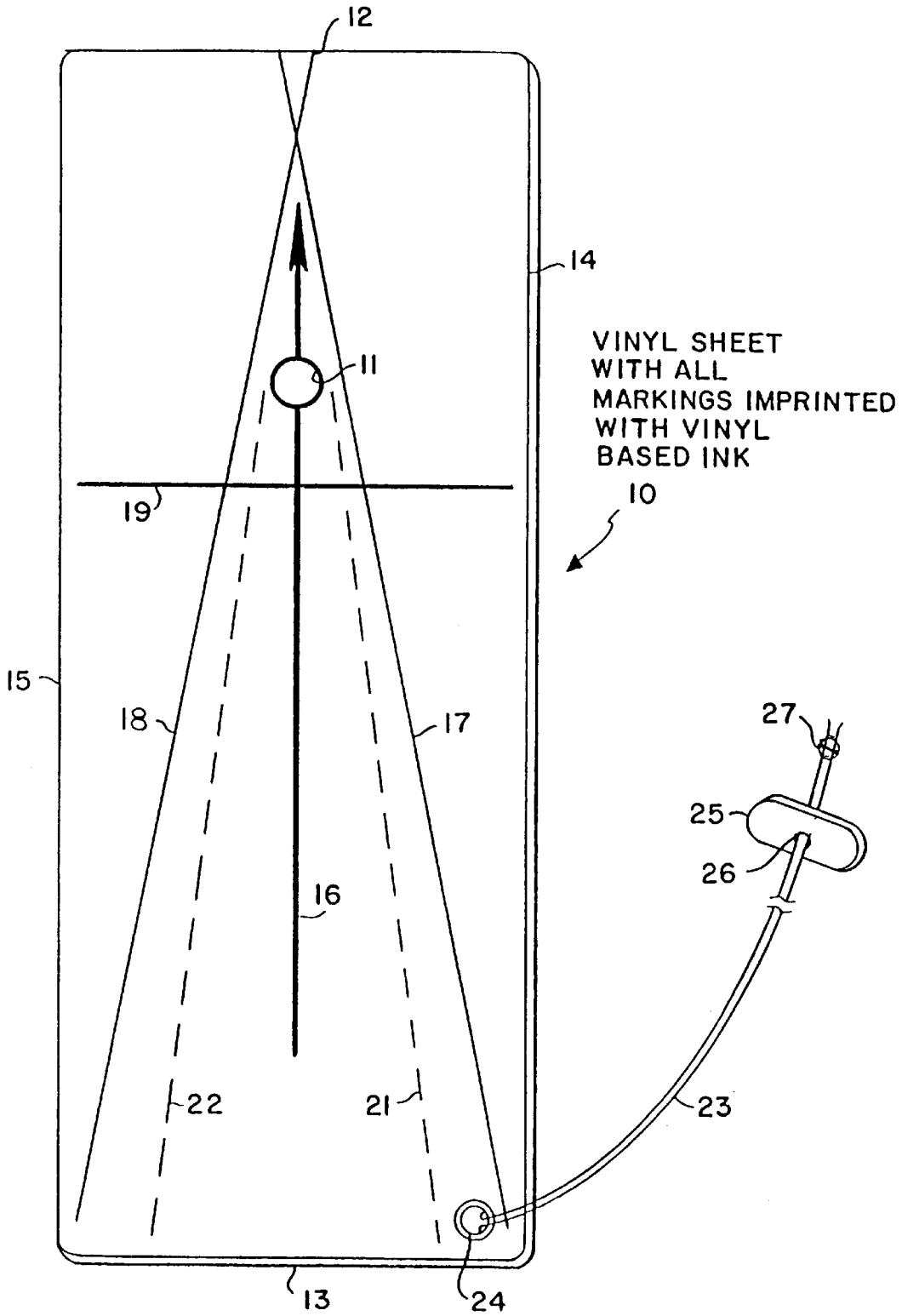
12
14
VINYL SHEET
WITH ALL
MARKINGS IMPRINTED
WITH VINYL
BASED INK
11
10
19
15
18
17
27
25
26
16
22
21
23
13
24

GOLF-SWING PRACTICE DEVICE

FIELD OF THE INVENTION

This invention relates to a device for aiding in the improvement of ones golf game by addressing a ball with the head of the club aligned perpendicular to the direction of a target and the golfer's feet and shoulders aligned parallel to that direction for a direct, in-line stroke or parallel to a line at a small angle in a direction on either side of that direct in-line direction to the target for either a fade or draw stroke.

BACKGROUND OF THE INVENTION

Golf-swing practice devices have been provided in two basic forms. One form that involves a golf practice mat is represented by U.S. Pat. No. 3,311,377 comprising a cushioning mat adhered to a hard board with a transparent sheet of polyester that overlies the mat and that has on the underside thereof white markings representing golf ball positions and reference lines indicating the correct direction of swing for various strokes, namely a straight in-line stroke or a fade (slice) or draw (hook) stroke to a target. With a marker affixed to the sole of the club head, the golfer takes practice swings over a golf ball image that is below the surface of the polyester sheet. The mark left on the sheet after each swing by that marker will indicate to the golfer the accuracy of the swing, thus allowing the golfer to make adjustments in stance, grip and/or body pivot necessary to achieve the desired direction of the golf club head over the image of the ball, which may be in-line or either from the inside to the outside (draw or hook) or from the outside to the inside (fade or slice) relative to a direct line to a target. A suction cup tee may be placed over the image of a ball to allow for actual practice strokes.

For either practice swings or actual strokes, the device of the aforesaid patent would be cumbersome to carry for use on a driving range or golf course. It would thus be best suited for use in one's own backyard for practice swings, but then one would not have an opportunity to test the swing with an actual stroke immediately after seemingly perfecting the swing to see if it will in fact produce the desired in-line, draw or fade stroke.

Another form of a golf-swing practice device that may be readily used on a driving range or a golf course is represented by U.S. Pat. No. 3,899,179 comprising a disk with an aperture for a golf tee. The disk is marked with a line passing through the center of the aperture to be aligned with the direction of the target. A string is attached to the disk at a point 90° from an arrow indicating the direction of the target. When in use, the string is placed on the ground in a line perpendicular to the line indicating the direction of the target to serve as a guide for positioning the golfer's stance. Such a golf-swing practice device is thus quite limited in providing a guide for improving consistency in the golfer's in-line stroke. What is required is a golf-swing practice device that may be readily carried in a golf bag to a driving range or golf course for use not only as a guide to position ones stance relative to a golf ball for an in-line stroke but also as a guide for a draw or fade stroke.

STATEMENT OF THE INVENTION

A golf-swing practice device in accordance with the present invention comprises a rectangular sheet about 35 cm in length from one end to the other and 13 cm in width having an aperture about 1.5 cm in diameter set about 9.5 cm from said one end and centered between the sides of the sheet. A bar is marked on one side of the aperture opposite that one end of the sheet about 2 cm from the center of the aperture and parallel to said one end, i.e., perpendicular to the sides of the sheet. The purpose of the aperture is to receive a golf ball tee and the purpose of the bar is to aid the golfer while addressing the ball with the face of the club head parallel with the bar for not only an in-line stroke to the target but also a draw (hook) or fade (slice) stroke to the target.

An arrow is marked on the sheet and aligned with the center of the aperture pointing in a direction toward said one end of the sheet and parallel with the sides of the sheet. The head of the arrow lies between the aperture and that one end of the sheet while the shaft of the arrow extends from the aperture toward the opposite end of the sheet. In use, the sheet is oriented with its arrow pointing in the direction of the target, often the flag at the next green. In addition to the arrow, two lines are drawn on the sheet, one on each side of the arrow and crossing at an acute angle (about 20° ) to each other, from near the back corners of the sheet opposite the one end and crossing in front of the aperture.

For an in-line stroke, the device aids the golfer in addressing the ball before taking a back swing with a golf club head square with the arrow, i.e., with the golf club face parallel with the bar behind the ball. Upon swinging the club head through the ball, the club head will thus impact the ball square with the direction to the target. For a draw or fade stroke, the arrow on the sheet is again aligned with the target and the ball is addressed as before using the normal stance, i.e., with feet and shoulders parallel to the arrow and the club head parallel with the bar behind the ball. Then, after realigning the feet and shoulders parallel to the draw or fade line on the sheet and keeping the club head parallel to the bar on the sheet, a normal swing is taken thus producing a draw or fade stroke with the head of the club square with the arrow pointing to the target but moving along the draw or fade line.

The novel features that are considered characteristic of this invention are set forth with particularity in the appended claims. The invention will best be understood from the following description when read in connection with the accompanying drawings.

BRIEF DESCRIPTION OF THE DRAWINGS

The sole FIGURE is a plan view of a golf-swing practice device imprinted with guide marks in accordance with the present invention with four marks, namely an arrow to be aligned with a target, a bar perpendicular to the arrow and behind an aperture for a ball tee, and two lines on the arrow in front of the aperture and equally spaced from the center of the aperture.

DETAILED DESCRIPTION OF THE INVENTION

Referring to the sole FIGURE, it shows in a planar view the golf-swing practice device made in accordance with the present invention as a rectangular, flexible plastic sheet 10, preferably with slightly rounded corners for convenience in handling while putting it in a golf bag and an aperture 11 is provided in the sheet for allowing a tee to be inserted in the ground, such as on a golf course, or protruding upwardly from a mat on a driving range where the device is placed on the mat with the aperture over an upright rubber tube serving as a tee.

The rectangular sheet 10 is preferably made of vinyl plastic of the type known as "virgin vinyl" because it is very resilient, when folded can be unfolded without leaving a crease, very strong in resisting scratches, cuts or tears and not harmful to golf clubs or the golfer. The vinyl plastic is die cut from larger sheets 2 mm thick to a convenient size for storage in a golf bag, namely about 35 cm long from one end 12 to the other end 13 and about 13 cm wide from side 14 to side 15. The aperture 11 is cut about 9.5 cm from the one end 12 and is preferably made about 1.5 cm in diameter in order to allow the rubber tee in a golf range mat to protrude though it. An arrow 16 passing through the center of the aperture 11 is imprinted on the sheet, either on the underside or the upper side, together with two lines 17 and 18 crossing in front of the arrow 16 at an acute angle of about 20° centered on the arrow 16 which is to be aligned with the direction of the target, usually the flag on the next green. A bar 19 is also marked on the sheet 10 about 2 cm behind the center of the aperture 11 and perpendicular to the arrow 16 and to the sides 14 and 15 of the sheet 10, In use for golf-swing practice, the device is placed on the ground or on the driving range mat with a tee in the aperture 11 and the arrow oriented in the direction of the target to which a ball is to be driven by a golf club. The golfer than takes a stance with both feet and shoulders parallel to the arrow 16 and the face of the golf club head parallel to the bar 19. Although that is the preferred normal stance for an in-line stroke, the golfer may shift the foot farthest from the target back about half the length of that foot. In either case, the markings on the sheet 10 will aid the golfer in assuming a normal stance with shoulders parallel to the arrow before hitting the ball in the direction of the arrow 16 for a direct in-line stroke to the target.

Occasionally, a direct in-line stroke to the target is not desired because of an obstacle directly in the straight line path to the target. In that case, the normal stance is first taken with the club head addressing the ball with its face parallel to the bar 19 and both the feet and shoulders parallel to the arrow 16 or the feet very nearly parallel to the arrow and the shoulders parallel to the arrow. Then, without changing the orientation of the club head with respect to the bar 19 and the arrow 16, the feet are adjusted to be parallel or nearly parallel to either the fade (slice) line 17 or the draw (hook) line 18 and the shoulders perfectly parallel to the fade or draw line selected. While the transition from the normal stance is being made, the golfer's grip of the golf club shaft is loose. After the transition is complete, the normal firm grip is taken by the golfer while keeping the face of the club parallel to the bar 19. Alternatively, the golfer's grip may be tight, but care must then be taken to keep the face of the club parallel to the bar 19, i.e., square to the direction of the target.

The result is that with a normal swing, as though an in-line stroke is being taken, the swing of the golf club head through the ball is in a direction about 10° to one side or the other of the arrow 16 along the line 17 or 18. Thus, in the case of a swing along the fade line 17, the stroke is actually made with a normal swing in a direction to the left of the target but with the club head "open" instead of square with respect to the line 17 of the swing. This causes the ball to fade or slice to the right in flight and then curve back bringing it on target while going around the obstacle to the left. Conversely, if a normal swing along the line 18 is made with the head of the club still parallel to the bar 19 after transition of the stance to be parallel with the line 18, the stroke is actually made with the club head "closed" with respect to the line 18 of the swing to cause the ball to draw or hook to the left while going around the obstacle to the right and back to the target.

When using the golf-swing practice device 10 at a driving range, it sometimes happens that the golfer will hit the device on a practice mat (not shown) at a point behind a tubular golf ball tee (not shown). When that occurs, the leading edge of the ball club head will bite into the vinyl sheet 10 and, as the club head travels forward at high speed, the vinyl sheet will buckle upwardly in the space between the tee and the point hit. As a result, the aperture 11 will ride up on the rubber tee of the driving range mat and when it reaches the top of the tee, the buckled sheet will spring out and forward a significant distance in front of the driving range mat. To retrieve it, the golfer would then have to run out in front of an arced line of other golfers hitting balls at the driving range, which is hazardous. For that reason, a hard and fast rule of all driving ranges is that one may not run out to retrieve a mishit ball, such as one topped so that it only rolls off the tee out in front of the arced line of practicing golfers, or to retrieve anything else. Therefore, as to the practice device 10, the driving range rule requires that all golfers practicing cease hitting balls while the device is retrieved.

To avoid the embarrassment of requiring the arced line of practicing golfers to stop hitting balls while the device is retrieved, a string 23 is attached to a rear corner of the sheet 10 through a grommet 24. The free end of the string is then attached to an oval-shaped tab 25 through a hole 26 in the center. A knot 27 is tied at the two ends of the string such that the knot is too large to slip back through the hole 26. This tab is to be inserted into a hole in the driving range mat (not shown) through which a rubber tee protrudes. The rubber tee is provided with a flange under the mat so that it will not fly out of its hole in the mat if hit by the club head. Consequently, the tab 25 attached to the practice device 10 is to be inserted through the hole in the mat past that flange. This is best accomplished by lifting the mat, pulling the tee out through the back of the mat while the tab 25 is inserted in that hole and then replacing the tee before the mat is placed back on the deck of the driving range.

In addition to the principal markings discussed above, there is marked within the segment between the fade and draw lines 17 and 18 additional lines 21 and 22 on each side of the arrow 16, each about 7.5° from the arrow. These two lines, 21 and 22, define a "safe" zone, i.e., a zone within which the direct in-line stroke is sure to yield a safe approach to the green. After aligning the stance (feet and shoulders) parallel to the arrow and addressing the ball with the club head parallel to the bar 19, i.e., square with the direction to the target, the path of the club head should not deviate from the line of the arrow 16 by more than the 7.5° limit of the lines 21 and 22. In executing the stroke, the head is to be fixed in space with eyes on the ball to serve as the pivot point of the pendulum-like swing of the club. Using peripheral vision, the golfer should watch for the swinging club to pass between those lines while using the device of this invention for practice.

All of the markings, 16 through 22, should be made on the vinyl sheet with a vinyl base printing fluid in order that the printed markings will fuse with the vinyl sheet and thus be resistant to being scraped off by the club head. To assure this resistance, it is preferred to apply a clear coat of vinyl on the sheet 10 after the markings are all in place.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. A golf-swing practice device for aiding in the improvement of a golfer's stroke of a golf ball on a tee with the head of a golf club comprising a sheet of flexible plastic having an aperture to accommodate said tee for support of said golf ball, an imprinted center line passing through the center of said aperture, two lines imprinted on said sheet crossing on one side of said aperture at an acute angle of about 20° between them, each of said two lines being spaced equally from the center of said aperture, and a bar imprinted on said sheet perpendicular to said center line on a side opposite said one side of said aperture for alignment of the face of said club head perpendicular to said center line in addressing said golf ball on said tee while the golfer's feet and shoulders are aligned parallel to either said center line for an in-line stroke of said ball in a direction in line with said center line or parallel to a selected one of said two crossing lines imprinted at an angle of about 20° between them for a fade or draw stroke of said ball launched along the selected one of said two crossing lines crossing at an acute angle but with a curved flight path back toward said direction in line with said center line.

2. A golf-swing practice device for aiding in the improvement of a golfer's stroke as defined in claim 1 further comprising indicia imprinted on said sheet to indicate a zone within said two crossing lines imprinted at an angle of about 20° along which a golfer in a stance with both feet parallel to said center line may deviate in the golf club swing from the ideal along said center line and still stroke a ball reasonably close to an ideal in-line stroke for an acceptable low score in terms of number of strokes required to reach the golf course green and putt said golf ball into a cup located on said green.

3. A golf-swing practice device for aiding in the improvement of a golfer's stroke as defined in claim 1 wherein said flexible plastic sheet is rectangular and said imprinted center line is parallel to the longer sides thereof and said aperture is closer to one end of said sheet and centered on said center line.

4. A golf-swing practice device for aiding in the improvement of a golfer's stroke as defined in claim 3 wherein said center line is an arrow having the arrow head thereof between said aperture and said one end of said sheet.

5. A golf-swing practice device for aiding in the improvement of a golfer's stroke as defined in claim 1 wherein said plastic sheet is made of vinyl plastic.

6. A golf-swing practice device for aiding in the improvement of a golfer's stroke as defined in claim 5 wherein said lines and indicia are imprinted with a vinyl based ink.

7. A golf-swing practice device for aiding in the improvement of a golfer's stroke as defined in claim 1 further comprising a string attached to said sheet and means attached to the free end of said string for attaching said string to a fixed point while in use.

8. A golf-swing practice device for aiding in the improvement of a golfer's stroke as defined in claim 7 wherein said means is a tab.

* * * * *